US010398186B2

(12) United States Patent
Staudinger

(10) Patent No.: US 10,398,186 B2
(45) Date of Patent: Sep. 3, 2019

(54) PROTECTIVE HELMET WITH COUPLING ELEMENTS

(71) Applicant: Rosenbauer International AG, Leonding (AT)

(72) Inventor: Peter Staudinger, Schlatt (AT)

(73) Assignee: Rosenbauer International AG, Leonding (AT)

( * ) Notice: Subject to any disclaimer, the term of this patent is extended or adjusted under 35 U.S.C. 154(b) by 195 days.

(21) Appl. No.: 15/534,544

(22) PCT Filed: Dec. 10, 2015

(86) PCT No.: PCT/AT2015/050312
§ 371 (c)(1),
(2) Date: Jun. 9, 2017

(87) PCT Pub. No.: WO2016/090400
PCT Pub. Date: Jun. 16, 2016

(65) Prior Publication Data
US 2017/0318888 A1 Nov. 9, 2017

(30) Foreign Application Priority Data
Dec. 10, 2014 (AT) ..... A 50896/2014

(51) Int. Cl.
*A42B 3/04* (2006.01)
*A42B 3/28* (2006.01)
*A62B 18/08* (2006.01)

(52) U.S. Cl.
CPC ..... *A42B 3/0406* (2013.01); *A42B 3/288* (2013.01); *A62B 18/084* (2013.01)

(58) Field of Classification Search
CPC ..... A42B 3/0406; A42B 3/288; A42B 3/185; A42B 3/20; A42B 3/205; A42B 1/064; A62B 18/084
(Continued)

(56) References Cited

U.S. PATENT DOCUMENTS 6,389,606 B1 * 5/2002 Galet ..... A62B 18/084 2/410
8,166,575 B2 * 5/2012 Haselmayer ..... A42B 3/166 2/10
(Continued)

FOREIGN PATENT DOCUMENTS

CN 101218000 A 7/2008
CN 102316937 A 1/2012
(Continued)

OTHER PUBLICATIONS

English translation of Schmidtke Klaus, Jun. 2009, DE102007063464, via espacenet.com on Feb. 8, 2019. (Year: 2019).*
(Continued)

*Primary Examiner* — Clinton T Ostrup
*Assistant Examiner* — Patrick J. Lynch
(74) *Attorney, Agent, or Firm* — Collard & Roe, P.C.

(57) ABSTRACT

A protective helmet, in particular a firefighting helmet, has a helmet shell and coupling arrangements which are arranged on either side in a temple region in each case and have first coupling elements for coupling in a releasable manner in each case to an accessory. The first coupling elements are retained on the helmet shell via a retainer of a connecting device in different positions one behind the other along a longitudinal axis of an adjustment path. Each of the first coupling elements has arranged thereon a first coupling member which is arranged in a first laterally offset position in relation to the retainer, which is arranged along the longitudinal axis of the adjustment path. Also, safety equipment includes such a protective helmet and at least one accessory coupled thereto.

10 Claims, 7 Drawing Sheets

Figure 1:
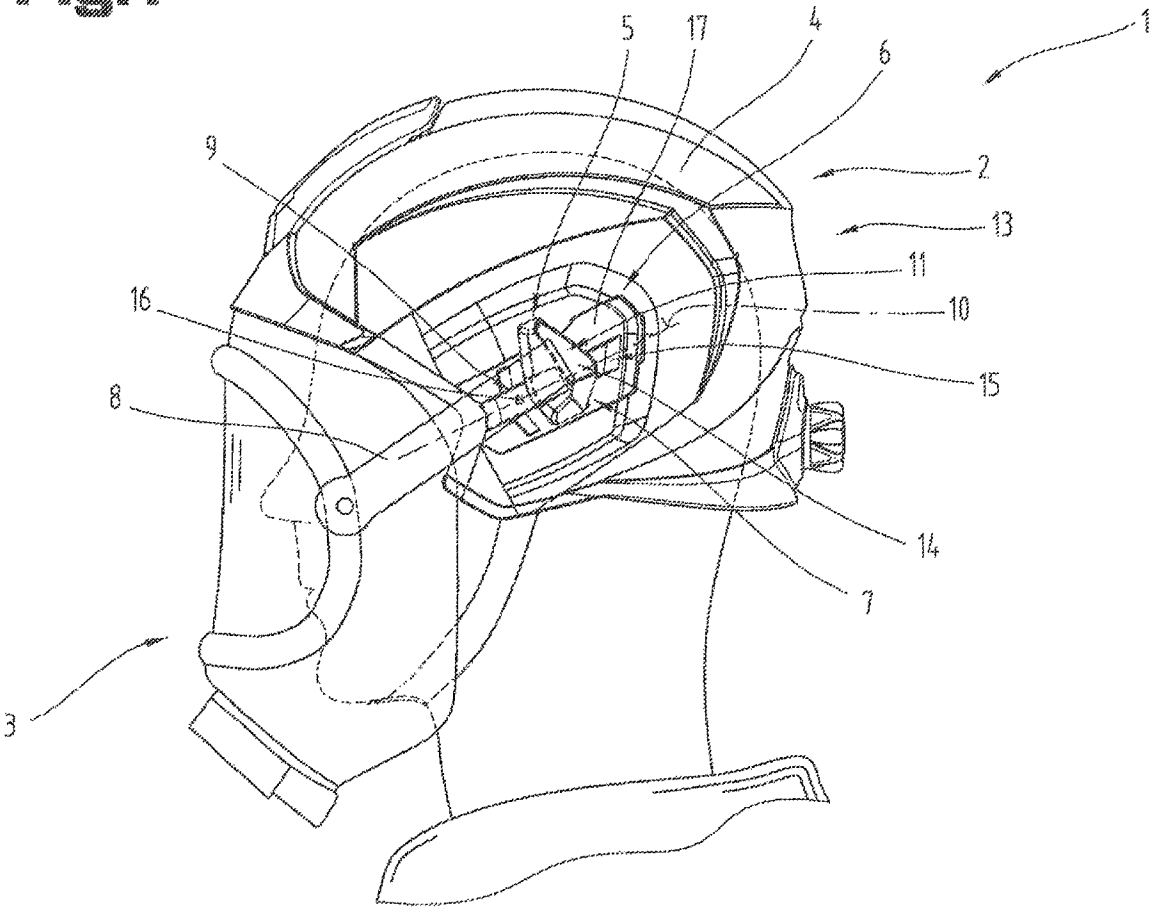

(58) Field of Classification Search
USPC ..... 2/422
See application file for complete search history.

(56) References Cited

U.S. PATENT DOCUMENTS

| | | | | |
|---|---|---|---|---|
| 9,839,252 | B2 * | 12/2017 | Krick | A42B 3/221 |
| 2004/0003453 | A1 * | 1/2004 | Urakawa | G02B 27/0176 2/422 |
| 2009/0235437 | A1 * | 9/2009 | Springer | A42B 3/185 2/422 |
| 2009/0307826 | A1 * | 12/2009 | Rogers | A42B 3/04 2/422 |
| 2010/0154093 | A1 * | 6/2010 | Provost | A42B 3/185 2/10 |
| 2010/0180364 | A1 * | 7/2010 | Willey | A42B 3/042 2/422 |
| 2011/0094019 | A1 * | 4/2011 | Isobe | A42B 3/222 2/424 |
| 2011/0314595 | A1 | 12/2011 | Kobayashi | |

FOREIGN PATENT DOCUMENTS

| | | | | |
|---|---|---|---|---|
| DE | 102007063464 | B3 * | 6/2009 | A42B 3/288 |
| EP | 0 720 497 | B1 | 7/1996 | |
| EP | 0995465 | B1 | 1/2003 | |
| EP | 1 881 861 | B2 | 4/2010 | |
| EP | 1 881 861 | B1 | 4/2014 | |
| FR | 2 676 652 | A1 | 11/1992 | |
| FR | 2 767 264 | A1 | 2/1999 | |
| GB | 2 417 905 | A | 3/2006 | |
| GB | 2 472 835 | A | 2/2011 | |
| GB | 2472835 | * | 2/2011 | A62B 18/08 |
| WO | 95/09675 | A2 | 4/1995 | |
| WO | 2006/114505 | A1 | 11/2006 | |
| WO | 2009/080532 | A1 | 7/2009 | |
| WO | 2013/068343 | A1 | 5/2013 | |

OTHER PUBLICATIONS

International Search Report of PCT/AT2015/050312, dated Apr. 15, 2016.

Search Report from Taiwanese Patent Application No. 2015104141619 dated Feb. 12, 2019.

* cited by examiner

PROTECTIVE HELMET WITH COUPLING ELEMENTS

CROSS REFERENCE TO RELATED APPLICATIONS

This application is the National Stage of PCT/AT2015/050312 filed on Dec. 10, 2015, which claims priority under 35 U.S.C. § 119 of Austrian Application No. A 50896/2014 filed on Dec. 10, 2014, the disclosure of which is incorporated by reference. The international application under PCT article 21(2) was not published in English.

The invention relates to a protective helmet, in particular a firefighting helmet, rescue worker's helmet, work helmet, industrial helmet, as well as safety equipment comprising such a protective helmet having at least one accessory that can be coupled therewith.

EP 1 881 861 BI respectively WO 2006/114505 A1 discloses such a protective helmet with a helmet shell and coupling arrangements with first coupling elements disposed on either side of the helmet shell in a temple region in each case. The first coupling elements are used for coupling in a releasable manner in each case to a second coupling element disposed on a breathing mask. The first coupling elements are also respectively retained on the helmet shell by retaining means of a connecting device in a succession of different positions along a longitudinal axis of an adjustment path. As a result, the breathing mask to be coupled with the protective helmet can be attached to allow for different lengths relative to the helmet shell. The coupling members provided on the first coupling elements are disposed respectively along the longitudinal axis of the adjustment path.

Another arrangement for releasably connecting a breathing mask to a protective helmet is disclosed in WO 2009/080532 A1. The respective holder has two separate upper and lower retaining elements extending away from each other from the breathing mask towards the protective helmet in a V-shape, which are coupled with the breathing mask and protective helmet at both ends by means of a rotary coupling point. The protective helmet and breathing mask are coupled by means of upper and lower rotary coupling points on the helmet and upper and lower rotary coupling points on the mask and by means of a flexurally slack design of at least one region on at least one of the retaining elements or at least one end portion of the retaining elements. The lower retaining element, essentially provided for holding the chin region of the breathing mask, runs substantially horizontally and the upper retaining element, essentially provided for holding the front region of the breathing mask, runs tangentially upwards. The retaining elements mounted in a pivoting arrangement on the breathing mask are close to one another and are attached to the protective helmet just above and below the pivot point. The two retaining elements on the helmet side are fastened by a connecting yoke which can be suspended on the protective helmet to prevent rotation. Due to the individual adjustability of the two retaining element, the inclination of the breathing mask relative to the protective helmet and the distance from it can be adapted.

The underlying objective of this invention is to propose a protective helmet whereby the position and hence the relative height of the coupling members with respect to the temple region on the protective helmet can be pre-set for the respective user in a simple manner. Furthermore, however, the intention is to also provide another coupling element of universal design on the protective helmet to which different accessories can be individually or jointly attached. In addition, safety equipment is proposed, based on a protective helmet of this type in combination with at least one accessory.

This objective of the invention is achieved due to the fact that at least one coupling member is provided or disposed on the first coupling elements respectively, which at least one first coupling member is disposed in a first laterally offset position in relation to the retaining means of the connecting device disposed along the longitudinal axis of the adjustment path. The advantages obtained as a result of the features described herein reside in the fact that due to the laterally offset position of the respective coupling member on the coupling element, the linkage region of the accessory to be connected to the protective helmet, in particular the breathing mask, can be easily pre-set in terms of height in the normal upright usage position of the protective helmet and adapted to the respective user. Depending on the selected pre-set point or position of the coupling member in relation to the retaining means of the coupling element on the protective helmet along the longitudinal axis of the adjustment path, an individual setting or pre-adjustment can be made specifically for the user. Accordingly, the relative angular position of the second coupling elements provided on the accessory can be to the physical size of the respective user. This lateral, transversely offset arrangement of the coupling member in relation to the respective retaining means of the connecting device can be achieved on the basis of an off-center or eccentric positioning on the first coupling elements.

It is also of advantage if the first coupling member of the first coupling element is provided in the form of a coupling seat, which is disposed on a side facing a rear head region of the helmet shell. This means that there is always a simple option for attaching the accessory, in particular the breathing mask, on both sides of the temple region. In addition, however, operating and mutually coupling the coupling elements to be engaged with one another can be easily done by the respective user, even if wearing gloves.

Another embodiment is distinctive due to the fact that the first coupling elements are respectively provided in the form of a left-hand and a right-hand design. This means that the coupling device can be provided on the basis of a small number of different components whilst preserving the option of varying the height setting.

Another possible embodiment incorporates features whereby the first coupling elements constituting the left-hand and right-hand design can be disposed on the helmet shell mutually interchangeably by means of the connecting devices, as a result of which the first coupling member is moved from its first laterally offset position in relation to the longitudinal axis of the adjustment path into a second laterally offset position. Without the need for additional components, it is still possible to provide an easy option for a pre-adjustment and individual adaptation to the respective user. Accordingly, not only can a position or length be adjusted for the accessory to be coupled, in particular the breathing mask, the angular position and hence the pulling direction of second coupling elements can be adjusted relative to the helmet shell.

Based on another embodiment, the first coupling elements are respectively guided along the adjustment path in a guide arrangement of the connecting device. Due to the lateral offset of the coupling members from the retaining means disposed along the longitudinal axis of the adjustment path, the first coupling elements are prevented from turning relative to the helmet shell. In this respect, the guide arrangement may be disposed so that it extends continuously along the adjustment path or alternatively, in the case of several retaining means in a stationary arrangement one after the other, the guide arrangement may be provided or disposed solely in the region of the retaining means.

Another embodiment is distinctive due to the fact that the mutually different positions of the first coupling elements disposed one after the other along the adjustment path are fixed by several recesses, in particular bores, disposed in a stationary arrangement relative to the helmet shell. This enables an exact fixed pre-positioning and hold of the individual first coupling elements to be obtained relative to the helmet shell of the protective helmet. Furthermore, however, a simple way of connecting and retaining the first coupling elements is obtained.

Another preferred embodiment is characterized by the fact that the positioned retaining means of the first coupling elements relative to the helmet shell is provided in the form of a connecting arrangement extending through at least one recess, in particular a screw connection. This results in a connection that can be operated using simple aids or tools. Furthermore, a retaining means is obtained which is also reliable and durable during use.

It is also of advantage if the two coupling arrangements respectively comprise an interconnecting piece which is detachably retained on the helmet shell, on which interconnecting piece the connecting device is respectively disposed and the first coupling element is held in position thereon. Providing an additional interconnecting piece between the helmet shell and coupling arrangements makes replacement easy in the event of damage. This also enables a covered arrangement of the retaining and/or connecting elements to be provided for the first coupling elements. This also avoids having to provide additional orifices in the helmet shell which would otherwise have to be covered separately depending on the individual disposition of the first coupling elements in order to prevent direct ingress to the helmet interior.

Another embodiment is distinctive due to the fact that the interconnecting piece incorporates both the guide arrangement for the first coupling elements and the recesses for receiving the connecting arrangement which extends through the recess, in particular the screw connection to the first coupling element. Using interconnecting pieces of different designs therefore means that there are more options for making changes and adaptations to suit the respective user without having to make modifications to the helmet shell. Furthermore, in the event of damage or changes to coupling elements on the accessory, these can be more cheaply changed and effectively replaced.

Based on another embodiment, a second coupling member is respectively provided or disposed on the first coupling elements. This offers the possibility of providing an individual coupling position for a first accessory on the protective helmet that is adapted to the user. In addition, however, providing a second coupling member on the same coupling element means that yet another accessory can be attached to the protective helmet. This enables the coupling element to be used for various purposes without having to change or swap the coupling element.

Finally, it has proved to be of advantage if the second coupling member has an engagement direction extending in a different orientation from that of the first coupling member to enable a third coupling element to be attached. This results in even greater individual adjustment, thereby enabling different accessories to be attached to the protective helmet.

The objective of the invention is also achieved independently by the features of safety equipment described herein. The advantages achieved as a result of the combination of features of the safety equipment reside in the fact that due to the laterally offset position of the respective coupling member on the coupling element, the linkage region of the accessory attached to the protective helmet can be easily pre-set and adapted to the respective user in terms of height when the protective helmet is in the normal upright position of usage. The relative angular position of the second coupling elements disposed on the accessory can therefore be adapted to the physical size of the respective user. This laterally or transversely offset arrangement of the coupling member relative to the respective retaining means of the connecting device may be achieved on the basis of an off-center or eccentric disposition of the first coupling elements. In addition, providing a number of coupling members on the first coupling element means that a range of different accessories can be used, either individually or simultaneously in combination with one another.

To provide a clearer understanding, the invention will be described in more detail below with reference to the appended drawings.

Figure 2:
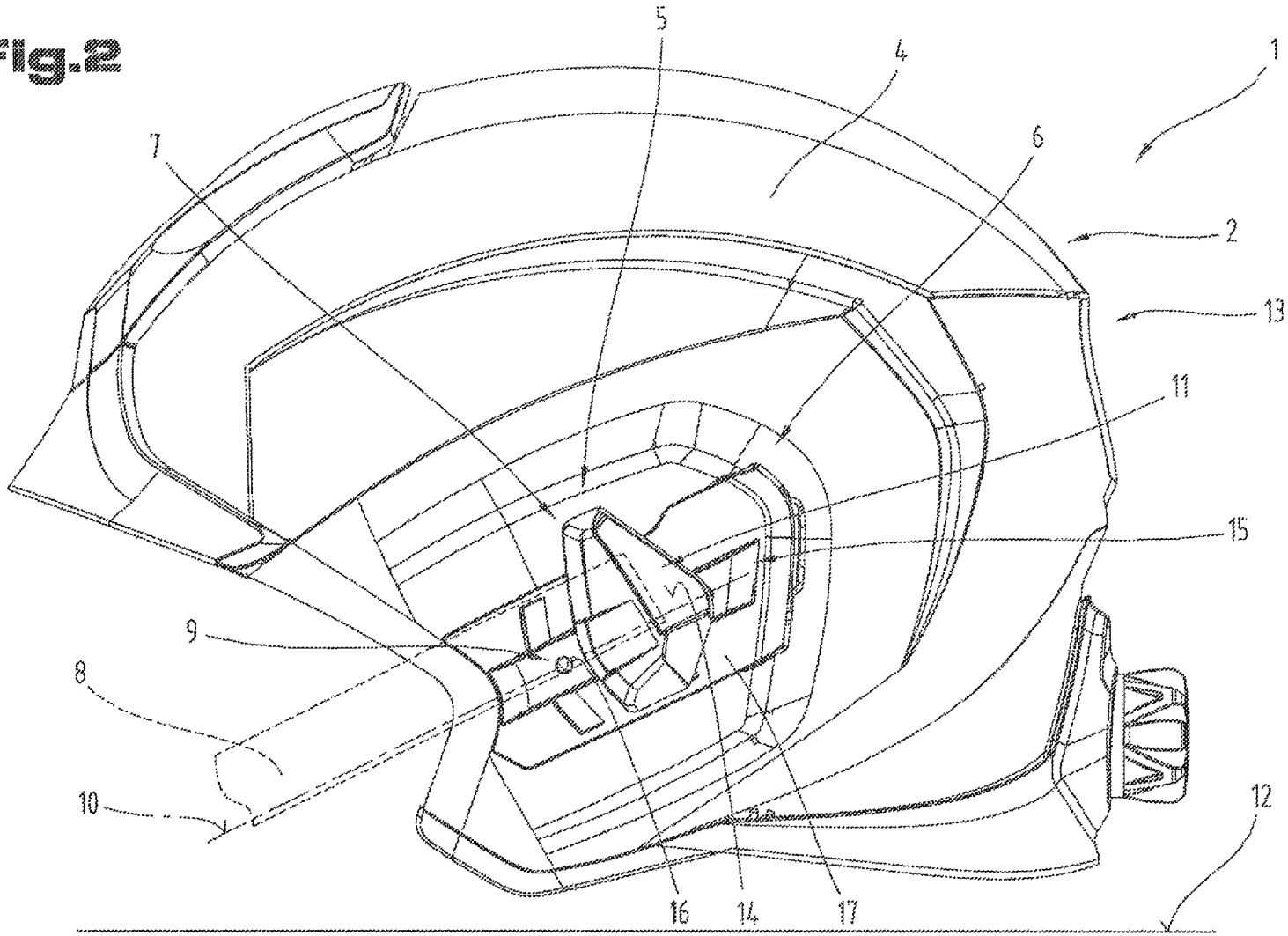
Figure 3:
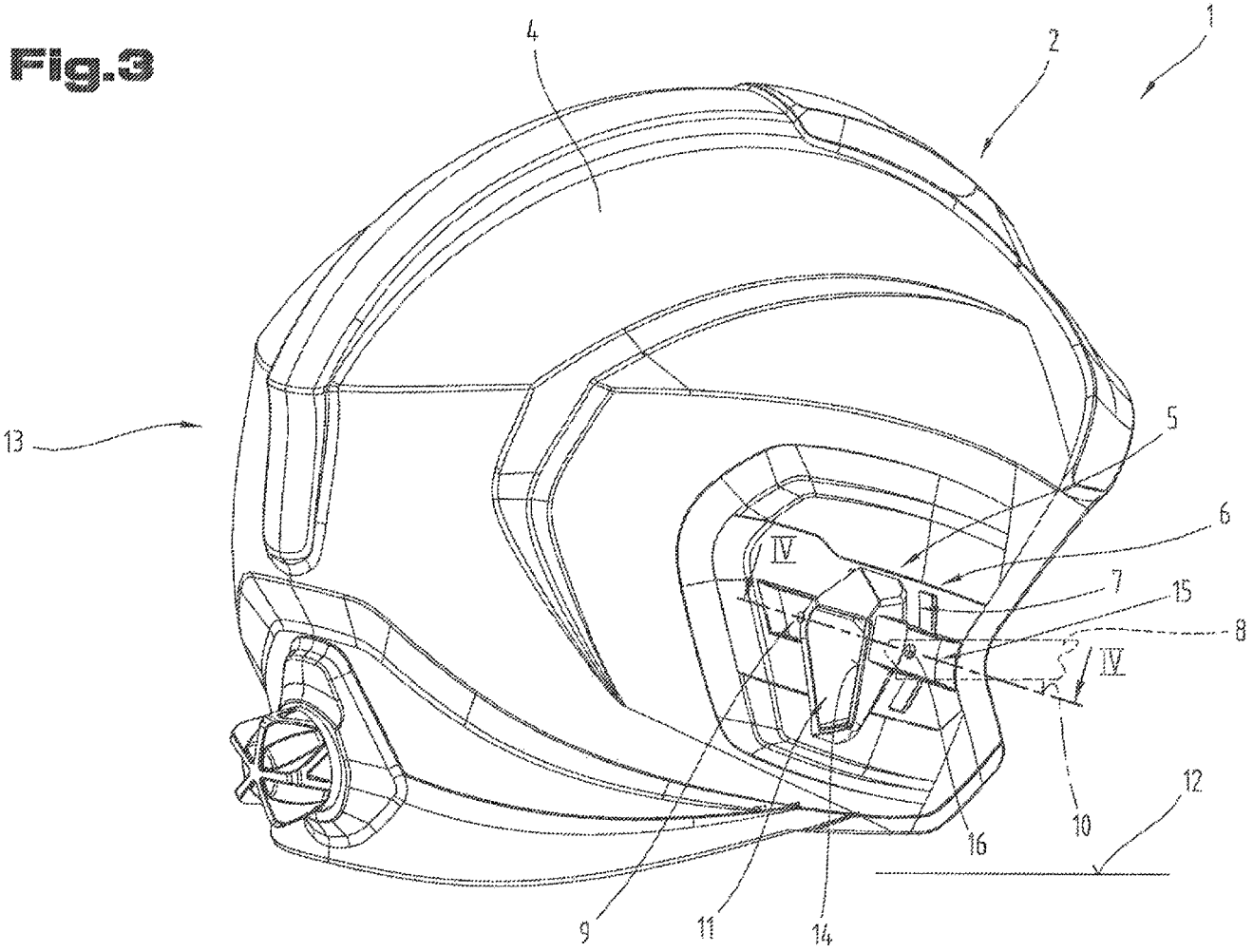
Figure 4:
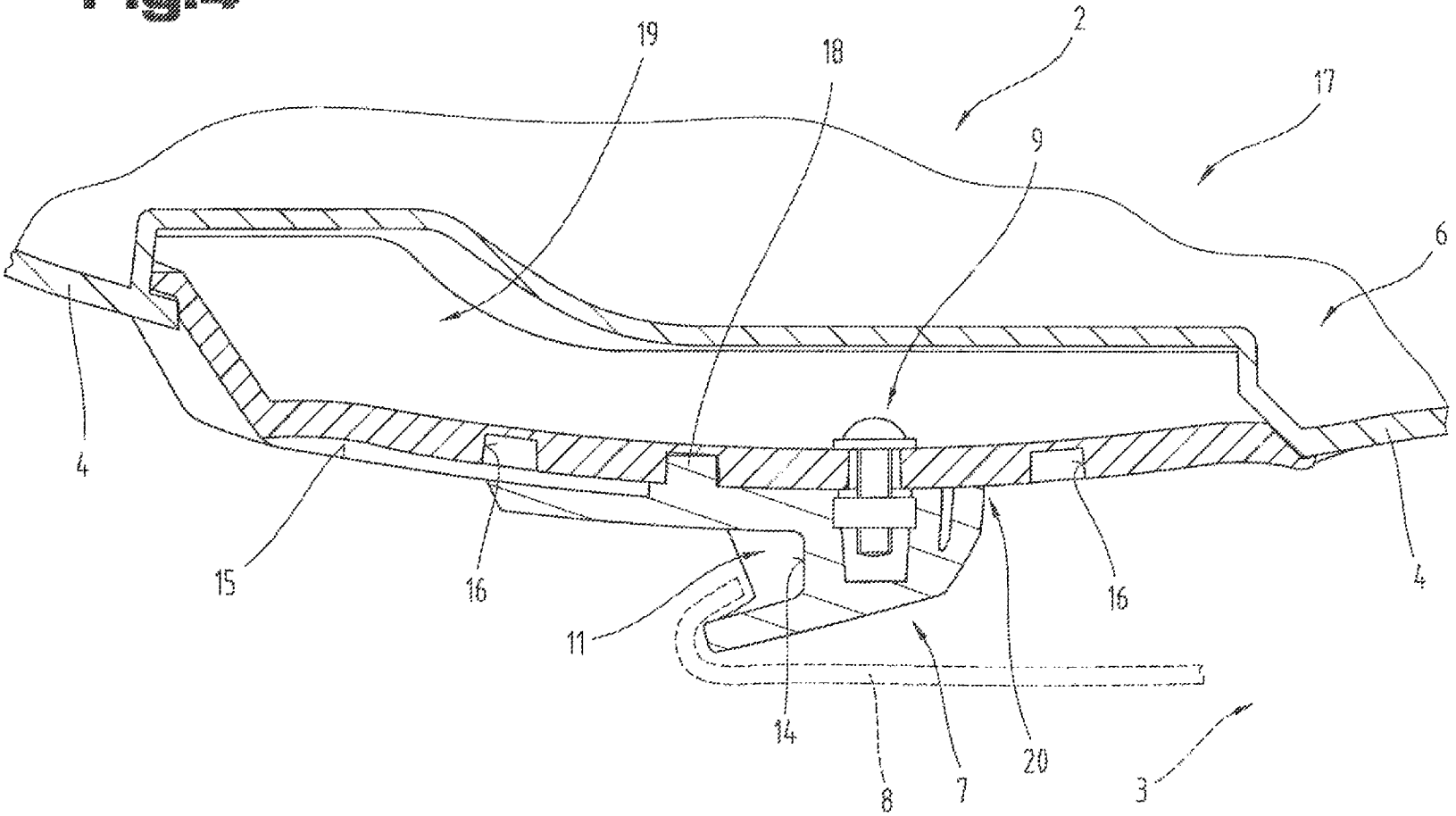
Figure 5:
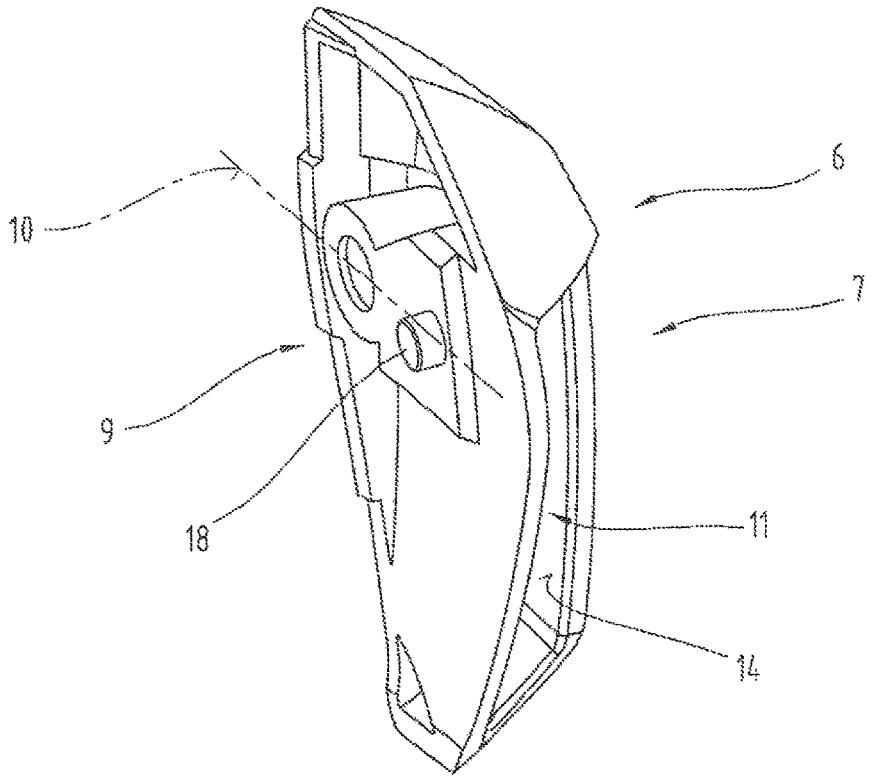
Figure 6:
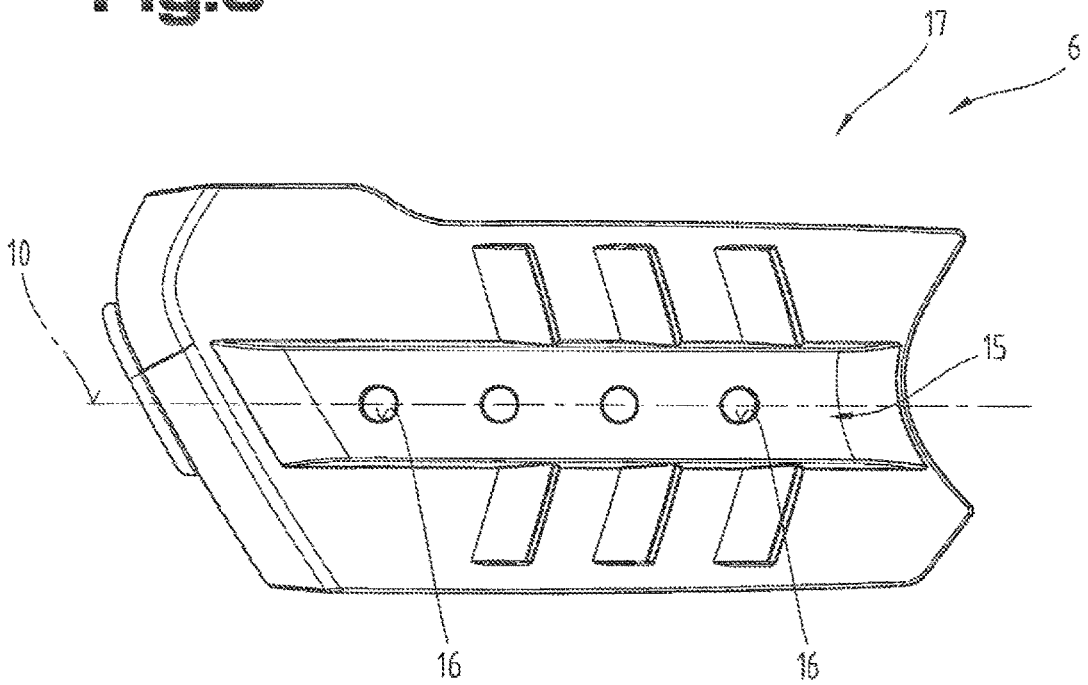
Figure 7:
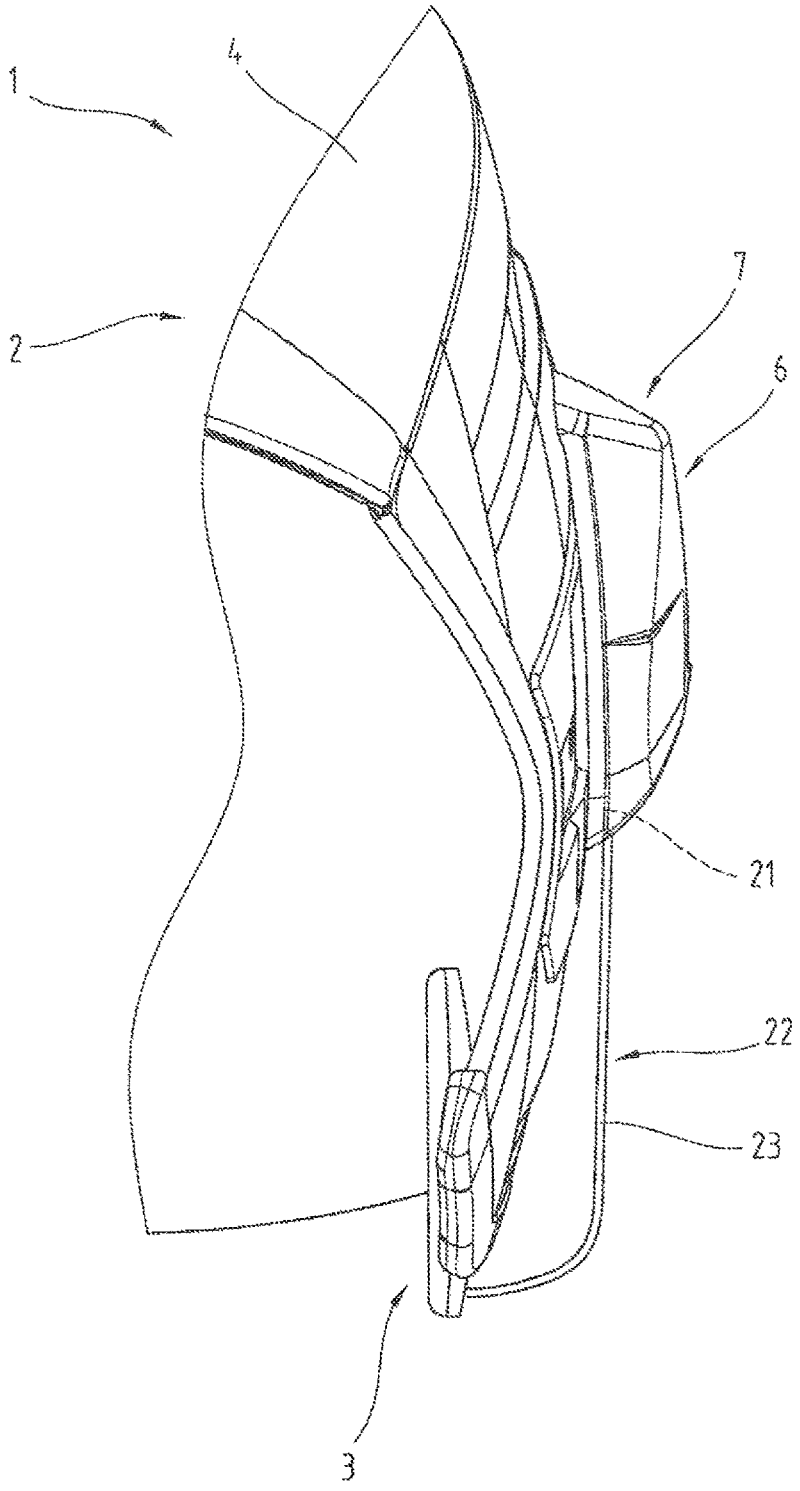
Figure 8:
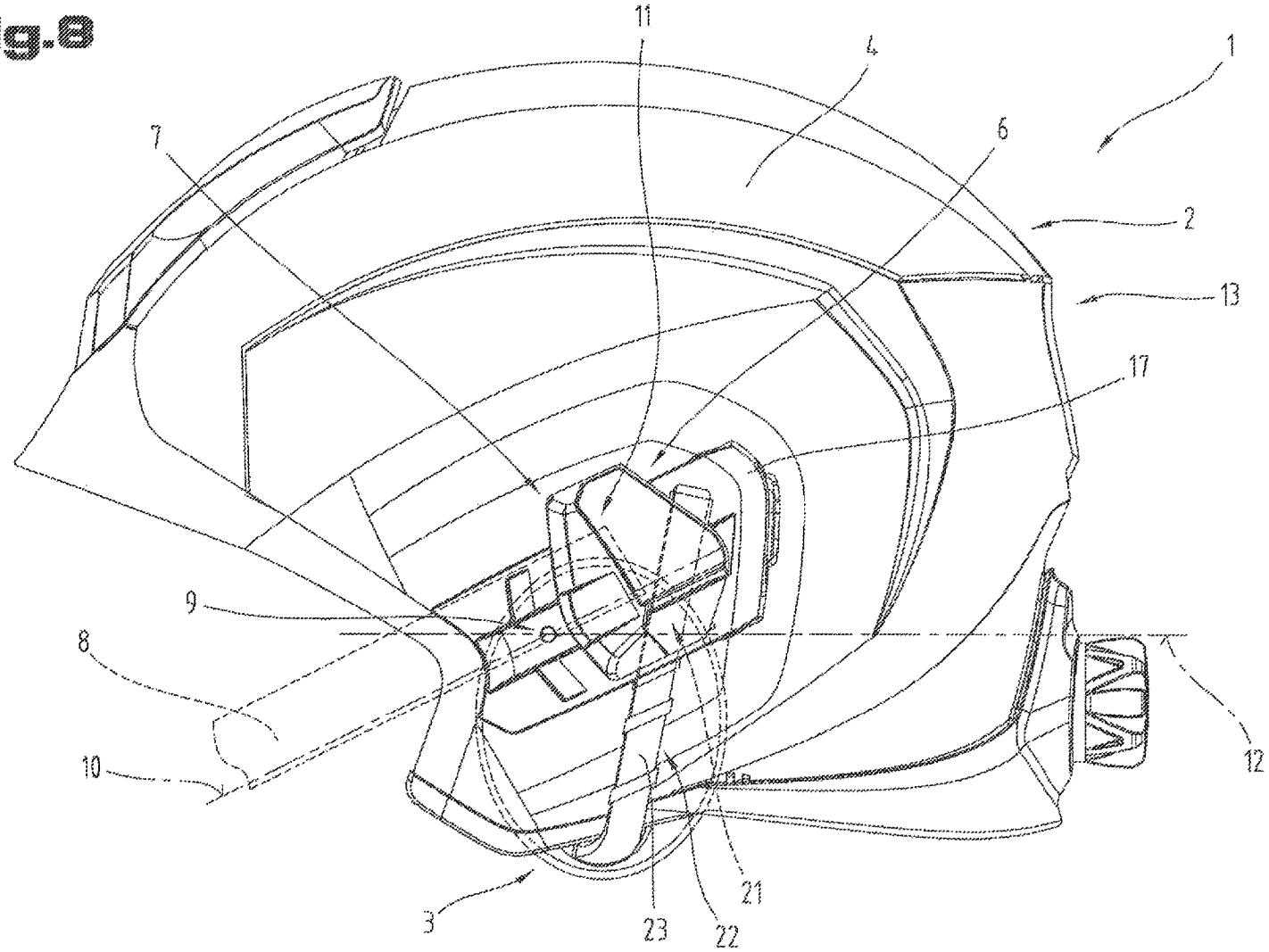

These are highly simplified, schematic diagrams illustrating the following:

FIG. 1 a side view illustrating safety equipment comprising a protective helmet and a breathing mask attached to it by means of a coupling arrangement;

FIG. 2 a side view of the protective helmet illustrated in FIG. 1 looking onto the left-hand temple region with an upwardly directed arrangement of the coupling member of the first coupling element;

FIG. 3 a side view of the protective helmet illustrated in FIGS. 1 and 2 looking onto the right-hand temple region but with a downwardly directed arrangement of the coupling member of the first coupling element:

FIG. 4 the coupling arrangement illustrated in FIG. 3 without the protective helmet, viewed in section along line IV-IV indicated in FIG. 3;

FIG. 5 a perspective diagram of the first coupling element with a downwardly directed coupling member viewed from inside towards the rear;

FIG. 6 a view in elevation of the interconnecting piece illustrated in FIG. 3 on its own;

FIG. 7 a view from the front showing another possible embodiment of a first coupling element having at least one second coupling member additionally provided or disposed thereon;

FIG. 8 a side view of the protective helmet of the safety equipment with the first coupling element illustrated in FIG. 7 and an accessory attached to it.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. The expression "in particular" used hereafter should be construed as meaning that a possible, more special embodiment is being described or a more specific aspect of an object or method step, but not necessarily a preferred embodiment as such.

FIGS. 1 to 6 illustrate a piece of safety equipment 1, in particular for use by the firefighting service, rescue services or for use at work, etc., comprising a protective helmet 2 and at least one accessory 3 that can be attached to it. The term accessory 3 should be understood as meaning a range of different components or application elements or fittings that can be attached to the protective helmet 2 or retained on it. Such accessories 3 may be selected from the group comprising breathing masks, helmet lamps, helmet cameras, dust masks, protective shields, face guards, ear protectors or hearing protection, for example. The protective shields might be an additional protective element pre-mounted in front of the helmet visor or one which is used instead of the latter, for example. It is therefore possible to attach or retain just one accessory 3 or alternatively several accessories 3 simultaneously on the protective helmet 2 and/or on the coupling element.

In the case of the accessory 3 described in detail below in the form of a breathing mask, there are various different embodiments which can be used to provide a connection or attachment to the protective helmet 2. The protective helmet 2 is specifically designed to provide a simple pre-setting option so as to be individually adaptable as well as to provide a simple way of attaching accessories 3 other than breathing masks to the protective helmet 2.

Since the protective helmet 2 is preferably used as a firefighting helmet, rescue worker's helmet, work helmet or industrial helmet, the design of the mutual coupling is also such that it can be used and operated wearing gloves.

The protective helmet 2 comprises at least one helmet shell 4, to which additional fittings can be attached, such as lamps, a chin strap, neck guard, suspension, retaining device, etc., although these will not be described in detail.

Attached to the helmet shell 4 described below are coupling arrangements 6, which are disposed respectively on either side in a temple region 5 or ear region thereof. Each of the coupling arrangements 6 comprises separate first coupling elements 7, which are designed to be releasably coupled with a second coupling element 8 which can be provided on or attached to an accessory 3 in the form of a breathing mask. The second coupling element 8 which can be provide on or connected to the mask-shaped accessory 3 in this particular example of an embodiment is a connecting arm having a flat profile or bar-type shape. Provided on the end region of the second coupling element 8 facing away from the accessory 3, in this instance a breathing mask, is a hook-shaped locating element designed to establish the coupled position in co-operation with the first coupling element 7.

Within certain limits, it may be possible to alter the length of the respective second coupling element 8 for the coupling operation with the protective helmet 2. Accordingly, when the protective helmet 2 is placed on the user's head, the accessory 3, in this instance a breathing mask, can be placed across the face region and by changing the length of the second coupling elements 8, the latter or their end regions facing away from the mask fastener can be coupled with the first coupling elements 7. The permissible change in length of the second coupling elements 8 is usually achieved by overcoming a rebounding or spring force, by means of which a reliable fit on the face of the user or person wearing the safety equipment 1 is obtained once the first coupling elements 7 have been correctly adjusted and/or pre-set. Accordingly, not only can a tight fit of the accessory 3, in this instance a breathing mask, on the face be obtained, a reliable mutual attachment between the protective helmet 2 and accessory 3 is also obtained.

The first coupling elements 7 are respectively retained in several different positions one after the other along a longitudinal axis 10 of an adjustment path on the helmet shell 4 by means of retaining means 9 of a connecting device 20. This may be achieved either directly on the helmet shell 4 or alternatively using an interconnected interconnecting piece 17 that will be described below. The different positions enable an arrangement to be obtained for the accessory or accessories 3 to be coupled whereby the position and/or length can be adjusted relative to the helmet shell 4. A more detailed description of the design of the connecting device 20, in particular the retaining means 9 thereof, will be given later.

At least one coupling member 11 is provided or disposed respectively on each of the first coupling elements 7. Based on this first example of an embodiment, only each first coupling element 7 is provided with a first coupling member 11 and the latter is disposed in a first position laterally offset from the retaining means 9 disposed along the longitudinal axis 10 of the adjustment path. In this particular example of an embodiment and when the protective helmet 2 is in the upright position of usage, "laterally offset position" should be understood as meaning that the first coupling member 11 is disposed either above or below the successively disposed retaining means 9. This lateral offset may also be described as a transverse offset. Due to this eccentric arrangement of the first coupling member 11 in relation to the longitudinal axis 10, the relative position of the respective first coupling member 11 can be set in relation to the retaining means 9 of the connecting device 20. A locating region that is laterally offset from the longitudinal axis 10 is therefore provided for the second coupling elements 8 by means of the first coupling members 11 disposed on the first coupling elements 7.

If the first coupling member 11 is disposed below the successively arranged retaining means 9—as is the case in the example of an embodiment illustrated in FIG. 3—the orientation or longitudinal extension of the second coupling element 8 of the accessory 3, in this instance a breathing mask, is somewhat flat in relation to a horizontal plane 12.

If, however, the first coupling member 11 is in a position above the successively arranged retaining means 9 of the connecting device 20, the orientation or longitudinal extension of the second coupling element 8 of the accessory 3 runs more steeply relative to the horizontal plane 12, as illustrated in FIG. 2.

In the embodiment illustrated here, the first coupling elements 7 are preferably provided in the form of a left-hand and a right-hand design. The respective first coupling elements are asymmetrical and are respectively provided in the form of a left-hand design and a right-hand design. As a result, the first coupling members 11 of the first coupling elements 7 may be disposed on a side facing a rear head region 13 of the helmet shell 4. The first coupling member 11 is provided in the form of a coupling seat 14 in this example of an embodiment. For example, the coupling seat 14 is a cut-out or recess in which the second coupling element 8 locates by means of a retaining hook or similar.

The first coupling elements 7 based on the left-hand and right-hand design can preferably fitted on the helmet shell 4 or attached thereto mutually interchangeably by means of the retaining means 9 of the connecting devices 20. This being the case, the first coupling member 11 can be moved from its first position transversely or laterally offset from the longitudinal axis 10 of the adjustment path—e.g. the position located below the longitudinal axis 10—into a second laterally offset position—i.e. into the position located above the longitudinal axis 10.

Due to the laterally or transversely offset arrangement or disposition of the first coupling member 1 on the first coupling element 7 and the possibility of mutual interchangeability, the coupling element 7 extends downwards in one instance and upwards in one instance relative to the longitudinal axis 10—as well as transversely to it—when the protective helmet 2 is in the upright position of usage. The first coupling member 11 may be laterally offset in a transverse axis extending transversely to the longitudinal axis 10, although this is not illustrated in detail.

Irrespective of the above, however, it would also be possible for the relative change in position of the first coupling member 11 of the first coupling element 7 to be achieved by means of a pivoting movement of the first coupling element 7 about a pivot pin on the helmet shell 4 standing out from it in a perpendicular orientation. Care must be taken to provide means for an appropriate locking action in the respective end positions. For example, a number of coupling members could also be provided on one of the first coupling elements 7 respectively around the circumference. The lateral offset of the respective coupling member can then be set relative to the longitudinal axis 10 depending on the relative angular position of the first coupling element 7.

In order to adjust the distance of the accessory 3, in this instance a breathing mask, from the helmet shell 4 of the protective helmet 2, the first coupling elements 7 may be guided respectively along the adjustment path in a guide arrangement 15 of the connecting device 20. This guide arrangement 15 is preferably provided in the form of a longitudinal guide. This will prevent the respective first coupling element 7 from turning relative to the helmet shell 4 to a certain extent.

The first coupling elements 7 can be fixed in a stationary position and thus retained relative to the helmet shell 4 in the different positions arranged successively along the adjustment path by means of a number of recesses 16, in particular bores, provided in a stationary arrangement relative to the helmet shell 4. The recesses 16 and/or bores are preferably disposed or arranged at the same distance from one another along the longitudinal axis 10 of the adjustment path. The mutual distance may also be described as a pitch distance or pitch. It would be possible to provide firstly only recesses 16 which do not extend completely through the entire wall thickness.

To provide a mutual connection between the first coupling element 7 and the helmet shell 4, a connecting arrangement may be provided extending through at least one of the recesses 16 in each temple region 5, in particular a screw for establishing a screw connection. In order to fit the connecting arrangement, the recess 16 is obtained by removing a wall part terminating the recess 16 in the axial direction to form an orifice enabling attachment. To this end, an internal thread may be provided or arranged in the first coupling element 7 in the region of the longitudinal axis 10. The internal thread may be formed either directly in the material of the first coupling element 7 or, alternatively, in a separate nut or insert disposed and retained in the first coupling element 7.

The connecting devices 20 for securing the first coupling elements 7 and subsequently for providing the coupling arrangements 6 in the region of the helmet shell 4 may be disposed or arranged directly on the latter. Irrespective of this, however, it would also be possible for the two coupling arrangements 6 forming the connecting devices 20 to be provided with an interconnecting piece 17 which is detachably retained on the helmet shell 4 in each case. This being the case, the first coupling elements 7 can be positioned on the helmet shell 4 and retained on it by fitting the interconnecting pieces 17 between. If providing the interconnecting pieces 17, these will incorporate both the guide arrangement 15 for the first coupling elements 7 and the recesses 16 for accommodating the connecting arrangement to the first coupling element 7 extending through the recess 16, in particular the screw connection. Again with the interconnecting pieces 17, a left-hand and a right-hand design are provided in each case. This in turn means that the left-hand and right-hand design of the coupling elements 7 will be mutually interchangeable. The interconnecting pieces 17 may preferably be interchangeably inserted in mounts for the interconnecting pieces specifically provided for this purpose on the external face of the helmet shell 4, where they are connected to the helmet shell 4. This can be achieved in a number of different ways, preferably using releasable connecting means. In order to adapt and individually adjust the first coupling elements 7 in terms of their position relative to the protective helmet 2 to suit the respective user, the interconnecting piece 17 must firstly be removed from the helmet shell 4 in order to gain access to the retaining means 9. By releasing the connection thereof to the first coupling element 7, the first coupling element 7 can be removed and then secured again in a different position. This unit is then secured to the helmet shell 4.

The retaining force exerted by the second coupling elements 8 on the first coupling members 11 of the first coupling elements 7 is transmitted in an approximately parallel or slightly inclined orientation relative to the longitudinal axis 10.

As may be seen from FIGS. 4 to 6 considered in combination, it would also be possible for the retaining means 9 of each of the connecting devices 20 to be provided with a locking element 18 on the first coupling element 7 in addition to the connecting arrangement extending through the at least one recess 16 described above. The locking element 18 may be provided in the form of a pin-shaped means arranged with the same spacing as the recesses 16 or at the same pitch thereof on the first coupling element 7. Accordingly, both a part of the connecting arrangement, e.g. the internal thread, and the locking element 18 are disposed on the first coupling element 7. In the mounted position, the latter are also oriented one after the other in the direction of the longitudinal axis 10 of the adjustment path. Due to the co-operation of the connecting arrangement and the locking elements 18, disposed one after the other in the direction of the longitudinal axis 10 and locating respectively in one of the recesses 16, the respective first coupling element 7 can be prevented from turning relative to the helmet shell 4. If opting for this combination of connecting arrangement and locking element 18, provision of the guide arrangement 15 for the first coupling element 7 may optionally be dispensed with.

The interconnecting pieces 17 can in turn be connected to or retained on the helmet shell 4 so as to be detachable. The connecting means used for this purpose can be freely selected, in which case a screw connection, clamp connection, snap-fit connection or similar may be used.

In order to provide a gap for mounting the connecting arrangement, in particular the screw, on the rear face of the interconnecting piece 17 directed towards the helmet shell 4, a space, in particular a chamber 19 at least partially bounded by circumferentially extending side walls, may be provided.

Accordingly, when the interconnecting piece 17 is fitted on the helmet shell 4, the connecting arrangement is not accessible from outside.

The safety equipment 1 is preferably intended for use by people working in the firefighting service, rescue services and emergency services and comprises the protective helmet 2 and an accessory 3 which in this example of an embodiment is provided in the form of a breathing mask which is used in conjunction with breathing apparatus, including bottles containing air ready for deployment which is usually stored at high pressure. This means that the wearer of the safety equipment 1 does not have to rely on the ambient air. This enables persons to fight a fire, for example, even in an atmosphere filled with smoke and/or noxious gases and possibly low in oxygen. Accessories 3 provided in the form of breathing masks are predominantly based on strapless designs where the second coupling elements 8 are usually articulatingly linked to a mask frame.

FIGS. 7 and 8 illustrate another and optionally independent embodiment of the first coupling element 7, the same component names and reference numbers being used to denote parts that are the same as those described with reference to FIGS. 1 to 6 above. To avoid unnecessary repetition, reference may be made to the more detailed description of FIGS. 1 to 6 given above.

The universally deployable first coupling elements 7 used to form the coupling arrangement 6 not only comprise the first coupling member 11 but also at least one other separate second coupling member 21 in this example of an embodiment. Using one and the same first coupling element 7, this offers the possibility of being able to either couple only one accessory 3 to one of the coupling members 11, 21 or alternatively to couple at least one accessory 3 each to each one of the coupling members 11, 21. Due to the different orientations and/or designs of the coupling members 11, 21, it is possible, for each of the coupling members 11, 21, to define a separate locating direction for the respective second coupling element 8 and/or a third coupling element 22 to be coupled.

As described above, the orientation of the second coupling elements 8 and hence the direction in which it locates relative to the longitudinal axis 10 of the adjustment path is selected so that it is more or less parallel with the latter or subtends only a slight angle with the longitudinal axis 10.

The second coupling member 21 may be provided in the form of a buckle, catch knob, recess, slot or such like, for example. The choice and hence design of the second coupling member 21 will depend on the third coupling elements 22 that need to be coupled.

For example, if the accessory 3 is provided in the form of ear protectors or hearing protection, the orientation and hence an angle of a supporting arm 23 thereof will be approximately between 20° and 90° relative to the longitudinal axis 10 of the adjustment path. By reference to the horizontal plane 12, the orientation and hence an angle subtended by the horizontal plane 12 and the supporting arm 23 will be between 70° and 120°, for example.

However, it would also be possible to couple or retain lamps, cameras, signal transmitters, communication means and similar on the second coupling member 21, in which case they will be provided with second coupling elements 8 or third coupling elements 22 of the appropriate design.

In all of the embodiments of the second coupling elements 8 described above, they may also be provided with other separate coupling members not described in detail here or may be partially formed by them.

For example, an individually adjustable coupling arrangement 6 can be made up of a range of different co-operating coupling elements 7, 8, 22.

Preferably, at least the first coupling elements 7 and also the interconnecting pieces 17, if used, are made from a plastic material, usually by an injection casting process. The material used might be PA 6 or PA 6.6, for example.

The embodiments illustrated as examples represent possible variants of the safety equipment 1, in particular its protective helmet 2, and it should be pointed out at this stage that the invention is not specifically limited to the variants specifically illustrated, and instead the individual variants may be used in different combinations with one another and these possible variations lie within the reach of the person skilled in this technical field given the disclosed technical teaching.

Furthermore, individual features or combinations of features from the different embodiments illustrated and described may be construed as independent inventive solutions or solutions proposed by the invention in their own right.

The objective underlying the independent inventive solutions may be found in the description.

Above all, the individual embodiments of the subject matter illustrated in FIGS. 1; 2, 3, 4; 5; 6; 7, 8 constitute independent solutions proposed by the invention in their own right. The objectives and associated solutions proposed by the invention may be found in the detailed descriptions of these drawings.

For the sake of good order, finally, it should be pointed out that, in order to provide a clearer understanding of the structure of the safety equipment 1, in particular its protective helmet 2, it and its constituent parts are illustrated to a certain extent out of scale and/or on an enlarged scale and/or on a reduced scale.

LIST OF REFERENCE NUMBERS

1 Safety equipment
2 Protective helmet
3 Accessory
4 Helmet shell
5 Temple region
6 Coupling arrangement
7 First coupling element
8 Second coupling element
9 Retaining means
10 Longitudinal axis
11 First coupling member
12 Horizontal plane
13 Rear head region
14 Coupling seat
15 Guide arrangement
16 Recess
17 Interconnecting piece
18 Locking element
19 Chamber
20 Connecting device
21 Second coupling member
22 Third coupling element
23 Supporting arm

The invention claimed is:

1. A protective helmet comprising:

a helmet shell having a first side and a second side; and a first coupling arrangement disposed or arranged on the first side of the helmet shell in a first temple region and a second coupling arrangement disposed or arranged on the second side of the helmet shell in a second temple region, wherein the first coupling arrangement and the second coupling arrangement have first coupling elements for coupling in a releasable manner in each case to a second coupling element which can be disposed or arranged on an accessory, the first coupling elements respectively being retained on the helmet shell via a retainer of a connecting device in a plurality of different positions along a longitudinal axis of an adjustment path to provide an arrangement whereby the position of the accessory to be attached can be varied relative to the helmet shell, wherein the respective first coupling elements are asymmetrical and are respectively provided in the form of a left-hand design and a right-hand design, wherein each of the first coupling elements has arranged thereon at least one first coupling member, which at least one first coupling member is arranged in an upright position of usage of the protective helmet in an eccentric first position above the longitudinal axis of the adjustment path when the first coupling element of the left-hand design is arranged on the first side of the helmet shell and when the first coupling element of the right-hand design is arranged on the second side of the helmet shell, the at least one first coupling member having an elongation, the elongation extending upward with respect to the helmet shell in the eccentric first position, and wherein the first coupling elements are configured to be detachable to the retainers of the helmet shell and are interchangeable such that:

the first coupling member of the left-hand design is movable from the eccentric first position on the first side of the helmet shell to the second side of the helmet shell and via the retainer of the second side is retainable on the second side by below the longitudinal axis of the adjustment path when the protective helmet is in the upright position of usage, the elongation of the first coupling member extending downward with respect to the helmet shell, and the first coupling member of the right-hand design is movable from the eccentric first position on the second side of the helmet shell to the first side of the helmet shell and via the retainer of the first side is retainable on the first side below the longitudinal axis of the adjustment path when the protective helmet is in the upright position of usage, the elongation of the first coupling member extending downward with respect to the helmet shell.

2. The protective helmet according to claim 1, wherein the first coupling member of the first coupling elements is provided in the form of a coupling seat, which is disposed on a side facing a rear head region of the helmet shell.

3. The protective helmet according to claim 1, wherein the first coupling elements are respectively guided along the adjustment path in a guide arrangement of the connecting device.

4. The protective helmet according to claim 3, wherein the first coupling elements along the adjustment path are fixed in different positions by several recesses disposed in a stationary arrangement relative to the helmet shell.

5. The protective helmet according to claim 4, wherein the retainer of the first coupling elements comprises a connecting arrangement extending through at least one recess.

6. The protective helmet according to claim 4, wherein the first coupling arrangement and the second coupling arrangement respectively comprise an interconnecting piece which is detachably retained on the helmet shell, on which interconnecting piece the connecting device is respectively disposed and the first coupling element is held in position thereon.

7. The protective helmet according to claim 6, wherein the interconnecting piece incorporates both the guide arrangement for the first coupling elements and the recesses for receiving the connecting arrangement.

8. The protective helmet according to claim 1, wherein a second coupling member is respectively provided or disposed on the first coupling elements.

9. The protective helmet according to claim 8, wherein the second coupling member has an engagement direction extending in a different orientation from that of the first coupling member to enable a third coupling element to be attached.

10. A safety equipment comprising the protective helmet according to claim 1 and the accessory coupled therewith.

* * * * *